US011619074B2

(12) United States Patent
Yasin et al.

(10) Patent No.: US 11,619,074 B2
(45) Date of Patent: Apr. 4, 2023

(54) SECURITY DEVICE FOR BOTTLES

(71) Applicants: Omar Yasin, Birmingham (GB); Chao Han, Shenyang (CN)

(72) Inventors: Omar Yasin, Birmingham (GB); Chao Han, Shenyang (CN)

( * ) Notice: Subject to any disclaimer, the term of this patent is extended or adjusted under 35 U.S.C. 154(b) by 534 days.

(21) Appl. No.: 16/773,380

(22) Filed: Jan. 27, 2020

(65) Prior Publication Data

US 2020/0240180 A1 Jul. 30, 2020

(30) Foreign Application Priority Data

Jan. 30, 2019 (GB) ..... 1901295

(51) Int. Cl.

| | |
|---|---|
| ***E05B 73/00*** | (2006.01) |
| ***B65D 45/32*** | (2006.01) |
| ***B65D 50/06*** | (2006.01) |
| ***B65D 55/14*** | (2006.01) |

(52) U.S. Cl.

CPC ..... *E05B 73/0041* (2013.01); *B65D 45/32* (2013.01); *B65D 50/067* (2013.01); *B65D 55/14* (2013.01); *B65D 2211/00* (2013.01); *B65D 2251/02* (2013.01)

(58) Field of Classification Search

CPC . E05B 73/0041; E05B 47/0038; B65D 45/32; B65D 50/067; B65D 55/14; B65D 2211/00; B65D 2251/02

USPC ..... 215/272, 277; 220/287, 319–321

See application file for complete search history.

(56) References Cited

U.S. PATENT DOCUMENTS 4,359,166 A * 11/1982 Dubach ..... B65D 45/322 215/272
4,625,890 A * 12/1986 Galer ..... B65D 45/327 220/795
5,957,313 A * 9/1999 Bouan ..... B65D 55/022 220/230
6,631,629 B1 * 10/2003 Fuss ..... E05B 73/0041 70/164
6,786,346 B1 * 9/2004 Gurnard ..... B65D 55/145 220/320

(Continued)

FOREIGN PATENT DOCUMENTS

WO WO-2006033124 A1 * 3/2006 ..... B65D 50/067

*Primary Examiner* — James N Smalley
(74) *Attorney, Agent, or Firm* — Dickinson Wright PLLC

(57) ABSTRACT

A security device for mounting over the neck of a bottle having an exterior lip has outer cap structure including an annular housing portion (16) for location about the neck of a bottle and an end cap portion (18) at one end of the annular housing portion. A claw member (14) is slidably mounted to the outer cap structure for movement in a direction parallel to a longitudinal axis of the annular housing portion between operative and inoperative positions. A latch mechanism (60) releasably secures the claw member in the operative position. The claw member has a plurality of resiliently deformable elongate claws (52*a*, 52*b*) for engagement with the neck of a bottle to which the device is mounted when the claw member is in the operative position. The claw member comprises at least two sets of claws (52*a*, 52*b*) of different lengths. The latch mechanism (60) may be a magnetically-releasable latch enabling the device to be removed using a magnetic key. The device may incorporate a RF or RFID tag.

20 Claims, 7 Drawing Sheets

(56) References Cited

U.S. PATENT DOCUMENTS

| | | | | |
|---|---|---|---|---|
| 8,777,031 | B2 * | 7/2014 | Aneas | B65D 51/241 215/277 |
| 2003/0047530 | A1 * | 3/2003 | Durbin | E05B 73/0041 215/386 |
| 2004/0163430 | A1 | 8/2004 | Belden, Jr. | |
| 2006/0043050 | A1 * | 3/2006 | Belden | E05B 73/0041 220/210 |
| 2008/0156764 | A1 | 7/2008 | Necchi | |
| 2009/0152230 | A1 * | 6/2009 | Belden, Jr. | E05B 73/0017 215/221 |
| 2012/0168398 | A1 * | 7/2012 | Zhang | E05B 73/0041 340/572.9 |
| 2012/0187072 | A1 * | 7/2012 | Belle | B65D 45/32 215/274 |
| 2015/0360826 | A1 * | 12/2015 | Fournier | B65D 41/16 215/277 |
| 2020/0299040 | A1 * | 9/2020 | White | B65D 55/14 |

* cited by examiner

SECURITY DEVICE FOR BOTTLES

TECHNICAL FIELD OF THE INVENTION

This invention relates to a security device which may be secured to a bottle and serve to reduce the likelihood of theft or misuse. The invention also relates to a method of using such a security device.

BACKGROUND TO THE INVENTION

It is common practice to attach a device in the form of a security label or tag to bottles displayed in a retail environment in order to prevent, or at least deter, theft. Such devices are arranged to trigger an alarm should a product to which the device has been attached be taken out of the store before the security device has been disabled or removed from the product.

US 2008/0156764 A1 to Necchi discloses a device in the form of a cap which can be mounted to the neck of a bottle and secured in position by means of a magnetically releasable latch. The cap includes an alarm element which is detectable by a retail alarm system such that the alarm is triggered if the cap passes within range of a detector. In addition to acting as an anti-theft device, the cap can be used as a safety device to prevent accidental or unauthorized access to the contents of a bottle as it physically prevents the contents of a bottle from being dispensed when secured in position. This is particularly advantageous where the contents of a bottle are potentially hazardous, e.g. alcohol, drugs or harmful substances.

The cap disclosed in US 2008/0156764 A1 has an external support body and a securing element with flexible locking wings for engagement with the neck of a bottle slidably mounted within the body. In use, the device is located over the neck of a bottle in released configuration and pressure applied to the outer body causing it to slide down over the securing element. Formations on the inside the outer body cause the locking wings to be pressed inwardly to engage the bottle neck as the outer body moves down over the securing element. A toothed, ratchet-like latching arrangement is provided between the securing element and the external support body which holds the outer body in position on the securing element once it has been depressed, unless released by a magnetic releasing device. Sufficient pressure must be applied to the outer body to securely clamp the locking wings to the bottle neck and there is a risk that the device may not be able to engage a bottle neck securely enough or that the pressure applied to the device may result in damage to any labelling applied to the bottle neck or over the bottle closure.

SUMMARY OF THE INVENTION

An object of the invention is to provide an alternative security device for bottles which overcomes, or at least mitigates, the drawbacks of the known security devices.

A further object of the invention is to provide an alternative security device for bottles which can be fitted to a broader range of bottle neck sizes and/or shapes than the known devices.

A still further object of the invention is to provide an alternative security device for bottles which can be applied by machine or manually.

Another object of the invention is to provide an alternative method of using such a security device.

According to a first aspect of the invention, there is provided a security device for mounting over the neck of a bottle having an exterior lip, the device having an outer cap structure including an annular housing portion for location about the neck of a bottle and an end cap portion at one end of the annular housing portion, a claw member slidably mounted to the outer cap structure for movement in a direction parallel to a longitudinal axis of the annular housing portion between operative and inoperative positions, and a latch mechanism for releasably securing the claw member in the operative position, the claw member having a plurality of resiliently deformable elongate claws for engagement with the neck of a bottle to which the device is mounted when the claw member is in the operative position, and wherein the claw member comprises at least two sets of claws of different lengths.

In an embodiment, the claw member has a first set of claws and a second set of claws, the claws in the first set being longer than the claws in the second set.

In an embodiment, the claw member comprises a body portion slidably mounted in the outer cap structure, the claws being spaced apart about the body portion. The claws of the first and second sets may be alternately disposed about the body portion.

In an embodiment, the claws are wholly received within the outer cap structure when the claw member is in the operative position whilst free end portions of the claws are located externally of the outer cap structure when the claw member is in the inoperative position.

In an embodiment each claw comprises an elongate resiliently deformable leg having a bottle neck engaging formation at one end. The device may be configured such that the bottle neck engaging formations are located externally of the outer cap structure when the claw member is in the inoperative position and are located within the outer cap structure when the claw member is in the operative position. In an embodiment, the bottle neck engaging formations comprise feet which extend from the free end of their respective claw legs in a first direction, the arrangement configured such that when the claw member is in the operative position, the claw feet are directed radially inwardly and towards the end cap portion for engagement with the neck of a bottle. In an embodiment, each claw comprises an abutment extending from the free end of the leg in the opposite direction to the foot for engagement with the annular housing portion, the arrangement configured such that when the claw member is in the operative position, engagement of the abutment with the annular housing portion holds the foot so that it extends radially inwardly and towards the end cap. The device may be configured such that when the claw member is in the inoperative position and the bottle engaging formations are located outside of the annular housing portion, each foot is biased by the resilience in its respective leg to project in a direction away from the end cap. Where the claw member has a body portion, each claw leg may be attached to the body portion and one end, the bottle neck engaging formation being located at the opposite end of the leg.

In an embodiment, each claw comprises a resiliently deformable leg mounted at one end to a body portion of the claw member and a bottle neck engaging formation an opposite, free end of the leg, the arrangement configured such that:

a) when the claw member is in the inoperative position, the free end of the claw projects externally of the outer cap structure and the bottle neck engaging formation is aligned at a first angle relative to the leg such that it is unable to engage with the neck of a bottle to which the device is mounted, and b) when the claw member is in the operative position, the free end of the claw and the bottle neck engaging formation are located internally within the outer cap structure, engagement between an abutment formation on the claw and the outer cap structure holding the bottle neck engaging formation aligned at a second angle relative to the leg different to the first angle such that, in use, it is biased into engagement with the neck of a bottle to which the device is mounted.

The bottle neck, engaging formation may have an abutment surface for engagement with the lip of a bottle neck to which the device is mounted in use, in which case, the first angle may be such that the bottle neck abutment surface is directed away from the end cap and the second angle may be such that the abutment surface is directed toward the end cap portion.

In an embodiment, the annular housing portion defines a central aperture which is open at a first end to receive the neck of a bottle, the central aperture being substantially closed at the opposite end by the end cap portion. The end cap portion and the annular housing portion may be initially separate components assembled together, say by welding.

The latch mechanism may comprise a magnetically-releasable latch element for securing the claw member in the inoperative position. In an embodiment, the claw member has one or more latch formations and the latch element is mounted in the outer cap structure for movement between a latching position and a release position, the arrangement being configured such that when the claw member is in the operative position and the latch element is in the latching position, the latch element engages the one or more latch formations to inhibit movement of the claw member to the inoperative position, and when the latch element is in the release position it does not engage the one or more latch formations and the claw member is able to move between the operative and inoperative positions. The latch element may be resiliently biased to the latching position, the latch element being movable to the release position against the bias when subjected to a selected magnetic field externally of the outer cap. The latch element may comprise a ferromagnetic member, such as a ferromagnetic screw. In an embodiment, the latch element is arcuate and mounted within the outer cap structure such that at least part of the body portion of the claw member passes within the latch element for movement between operative and inoperative positions, the body portion having at least two said latch formations projecting outwardly and spaced apart for engagement with the latch element when the latch element is in the latching position and the claw member is in the operative position.

In accordance with a second aspect of the invention, there is provided a method of using a security device as claimed in any one of the preceding claims, the method comprising applying the security device to a bottle using machinery.

The method may comprise applying the device to a bottle at a first location (such as a distillery or distribution centre) and transporting the bottle with the device applied to a second location (such as a retail outlet).

The method may comprise returning the device after it has been released from a bottle to the first location for re-setting and reuse.

DETAILED DESCRIPTION OF THE INVENTION

In order that the invention may be more clearly understood an embodiment thereof will now be described, by way of example only, with reference to the accompanying drawings, of which:

FIG. 20 is an enlarged view of detail E in FIG. 19.

Figure 1:
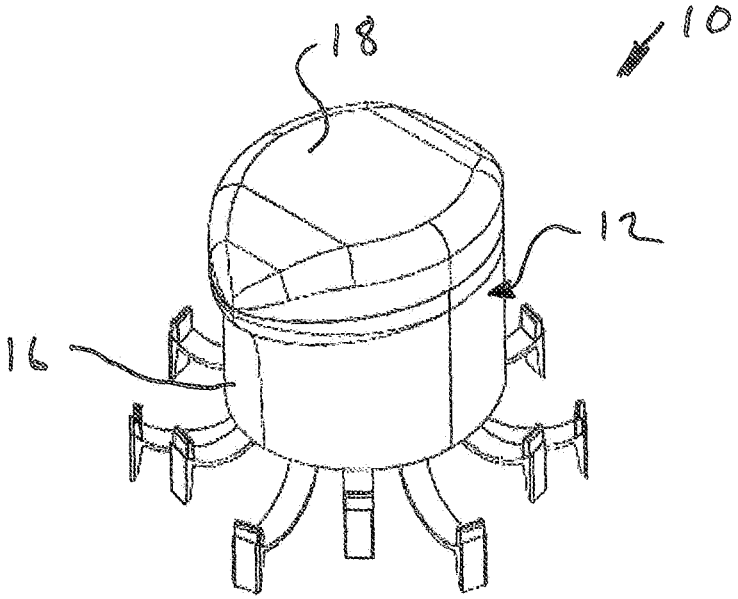
FIG. 1 is a perspective view of an embodiment of a security device for bottles in accordance with the invention, showing the device in a released configuration.
Figure 2:
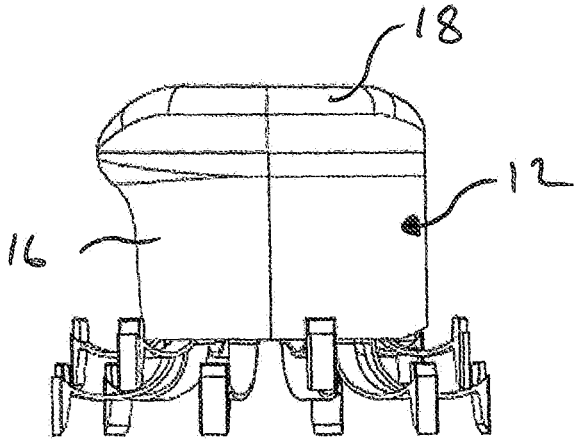
FIG. 2 is a side view of the security device for bottles of FIG. 1.
Figure 3:
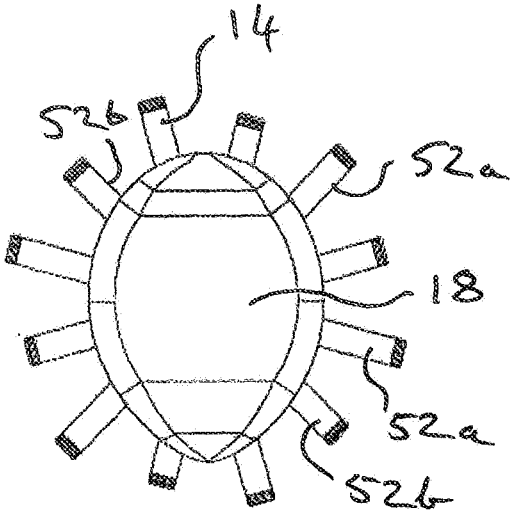
FIG. 3 is a top view of the security device for bottles of FIG. 1.
Figure 4:
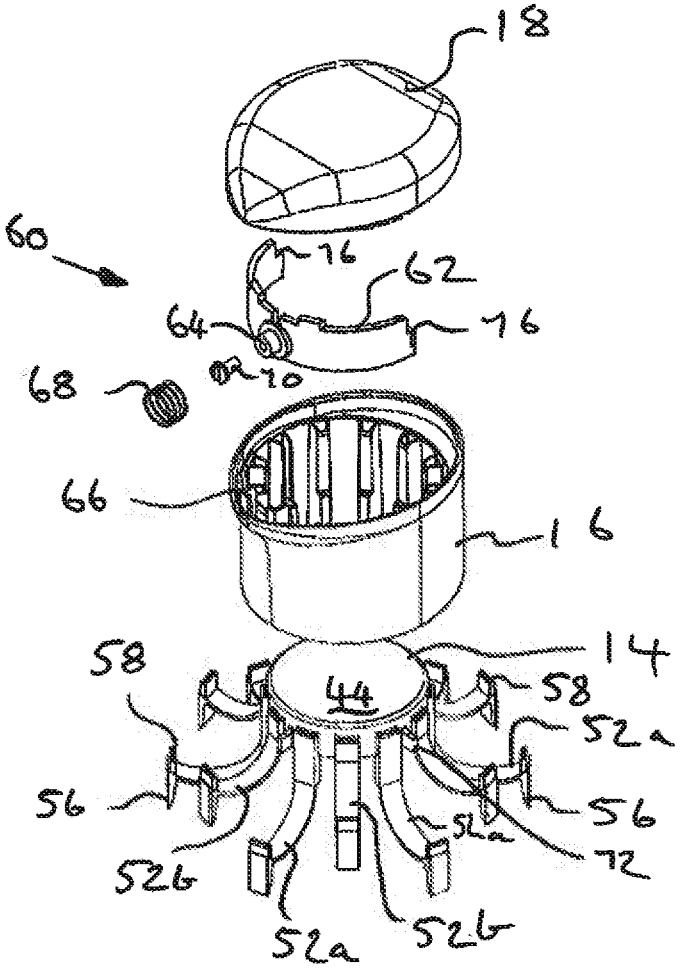
FIG. 4 is an exploded view of the security device for bottles of FIG. 1.
Figure 5:
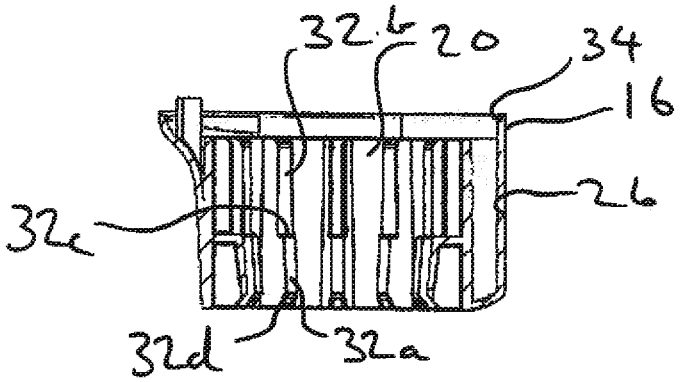
FIG. 5 is a cross sectional view through an annular housing portion forming part of an outer cap structure of the device of FIG. 1.
Figure 6:
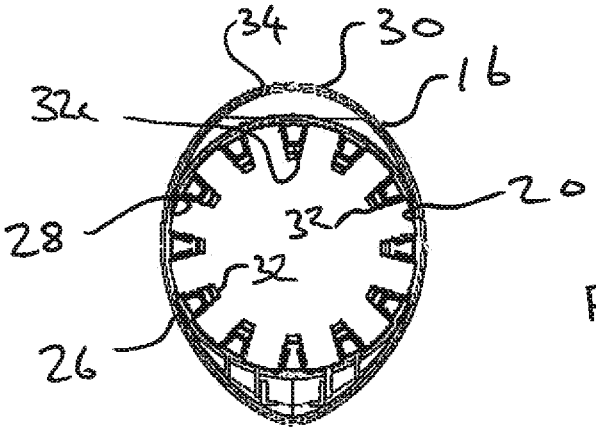
FIG. 6 is a plan view of the annular housing portion of FIG. 5.
Figure 7:
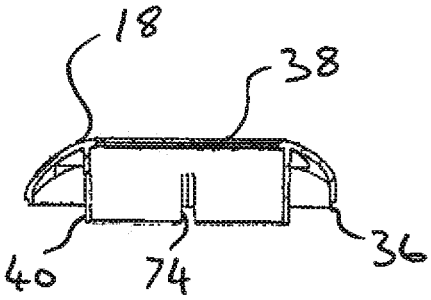
FIG. 7 is a cross sectional view through an end cap portion forming part of an outer cap structure of the device of FIG. 1.
Figure 8:
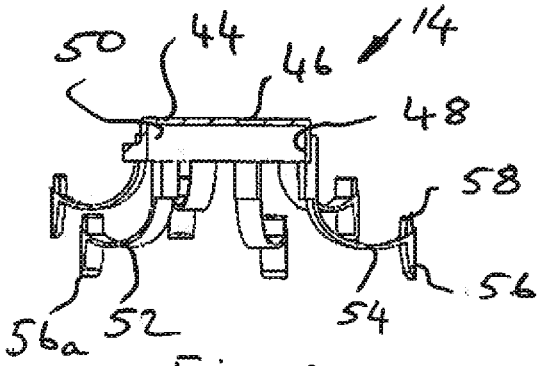
FIG. 8 is a cross sectional view through a claw member forming part of the device of FIG. 1.

An embodiment of a security device 10 for releasably mounting to the neck of a bottle in accordance with the invention has an outer cap structure 12 and a claw member 14 slidably mounted to the outer cap structure 12.

The outer cap structure 12 has a body including an annular housing portion 16 and an end cap portion 18, which are initially separate components. The annular housing portion 16 and the end cap portion 18 can be manufactured from any suitable materials but advantageously are both moulded from polymeric materials and are secured to one another by welding (for example by sonic welding) or by any other suitable means, such as by adhesive, after assembly of the device.

The annular housing portion 16 defines an internal aperture or recess 20 and is dimensioned to be fitted about the neck 22 of a bottle 24. The internal aperture 20 is open at a first, lower end of the annular housing portion 16 to receive the neck of a bottle but is closed at its opposite, upper end by means of the end cap portion 18. Accordingly, when the device 10 is mounted over the neck of a bottle, the outer cap structure 12 encloses the outer end region of the bottle neck preventing access to the bottle closure, typically a screw cap or cork.

Terms such as "upper" and "lower" and the like as used herein should be understood as referring to the relative orientation of the device (or part thereof) or a bottle to which the device is mounted when the device is positioned in an upright orientation with the end cap portion 18 uppermost as shown in the accompanying drawings. However, it will be appreciated that the device 10 can be used in different orientations and could be mounted to the neck of a bottle with the bottle in any orientation and such terms should be construed accordingly.

The annular housing portion 16 has an annular wall structure 26 having an inner surface 28 which defines the internal aperture 20. The internal aperture 20 is circular in the present embodiment, though in alternative embodiments the internal aperture could be non-circular and could be elliptical for example. The exterior 30 of the annular wall structure 26 in this embodiment is not circular but is generally elliptical. It will be understood therefore that the term "annular housing portion" is not limited to a housing portion which is circular but is intended to encompass any tubular or generally ring—like construction suitable for locating about the neck of a bottle.

A number of splines 32 project radially inwardly about the inner surface 28 of the annular wall structure 26 of the annular housing portion. The splines 32 are spaced circumferentially about the inner wall surface and are aligned parallel to a longitudinal axis of the annular housing portion, that is to say they extend in a direction from the first, lower end to the second, upper end. The splines 32 have a first, lower region 32*a* proximal the open end of the internal aperture 20 and a second, upper region 32*b* proximal the end cap portion 18. In the lower region 32*a*, the splines have a larger radial thickness than in the upper region 32*b* so that the splines define a transvers step 32*c* between the upper and lower regions. In the lower region 32*a*, the radially inner faces of the splines 32 slope radially inwardly in a direction from the transvers step 32*c* towards the open, first end of the annular housing portion but immediately adjacent the open, first end, they taper radially outwardly at 32*d*.

The annular housing portion 16 is profiled at its upper end to define an upwardly directed lip 34 which locates about a corresponding downwardly depending lip 36 on the end cap portion 18 to locate the end cap portion to the annular housing portion. The end cap portion 18 has an outer wall 38 which is profiled to form an end closure to the annular housing portion 16. An annular flange 40 projects inwardly (downwardly) from the inner surface of the outer wall and aligns generally with the radially inner surfaces of the splines 32 in the upper region 32*b*.

The claw member 14 has a circular body portion 44 having an upper wall 46 and a side wall 48 extending downwardly about the outer circumference of the upper wall 46. The body portion 44 defines a recess 50 in which the top of a bottle neck is received. The body portion 44 is slidably received within the upper region 32*b* of the splines 32. However, the outer diameter of the body portion 44 is larger than the inner diameter of the splines in the lower region 32*a* so that the body portion 44 cannot slide beyond the transvers step 32*c* in the splines. The body portion 44 is able to slide within the outer cap structure between a lower, inoperative position in which it engages with the step portions 32*c* of the splines 32 and a raised, operative position in which it locates within the annular flange 40 in the end cap portion 18.

The claw member 14 has a number of elongate, resiliently deformable claws 52 which depend from the body portion. Each claw 52 has an elongate, resilient deformable leg 54 attached at one end to the exterior of the side wall 48 of the body portion 44 and a bottle neck engaging formation 56 at the other, free end the leg. The claws 14 are spaced circumferentially about the side wall 48 so that each leg 54 locates in the gap between two adjacent splines 32. The claw legs 54 are in the form of elongate strips which are able to deform elastically in a plane parallel to the longitudinal axis of the annular housing member in the assembled device. The bottle neck engaging formations 56 take the form of feet which project from the free ends of their respective legs 54 in a first direction. Each claw also has an abutment 58 which projects at the free end of the leg in the opposite direction from the respective foot. The feet 56 are longer then the claw abutments 58 and free or toe end regions 56*a* of the feet are chamfered for engagement with a lip on a bottle neck. When the claws are in their normal resiliently biased configuration as shown in FIGS. 1 to 4, 8 and 15, the legs 54 curve downwardly and radially outwardly from the side wall 48 of the body portion, the feet 56 extend downwardly (in a direction away from the body portion 44) at the free ends of the legs and the abutments 58 project in the opposite direction to the feet, that is to say upwardly (in a direction towards the body portion 44).

The claw 14 member can be manufactured from any suitable material and by any suitable method but advantageously is moulded from a suitable polymeric material.

The claw member 14 has two sets of claws, a first set 52*a* and a second sect 52*b*. The legs 54 of the claws in the first set 52*a* are longer than the legs 54 of the claws 52*b* in the second set, though the claws in the two sets are otherwise the same. The claws 52*a*, 52*b* in the first and second sets are alternately disposed about the body portion 44. The claw member is dimensioned so that when in the lower, inoperative position with its body 44 abutting the stepped regions 32*c* of the splines, free end regions of all the claws extend below the lower edge of the outer cap structure 12 as illustrated in FIGS. 1 to 4. In this position, the claws adopt their natural resiliently biased configuration with the legs 54 curving radially outwardly and the bottle neck engaging feet 56 projecting downwardly (away from the end cap portion 18) radially outboard to the outer cap structure 12. In this configuration, the feet 56 are not able to engage with the neck of a bottle on which the device 10 is mounted.

Figure 16:
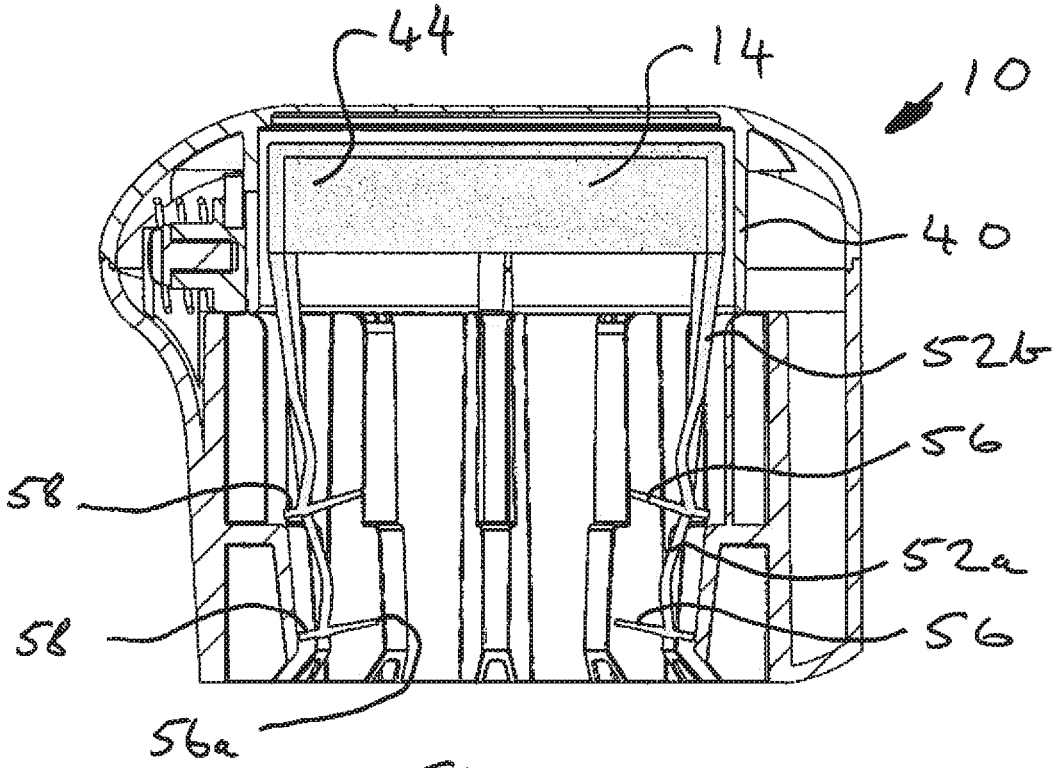
FIG. 16 is across sectional view through the device of FIG. 1 showing the device in an operative configuration ready for placement on the neck of a bottle.
Figures 17, 18:
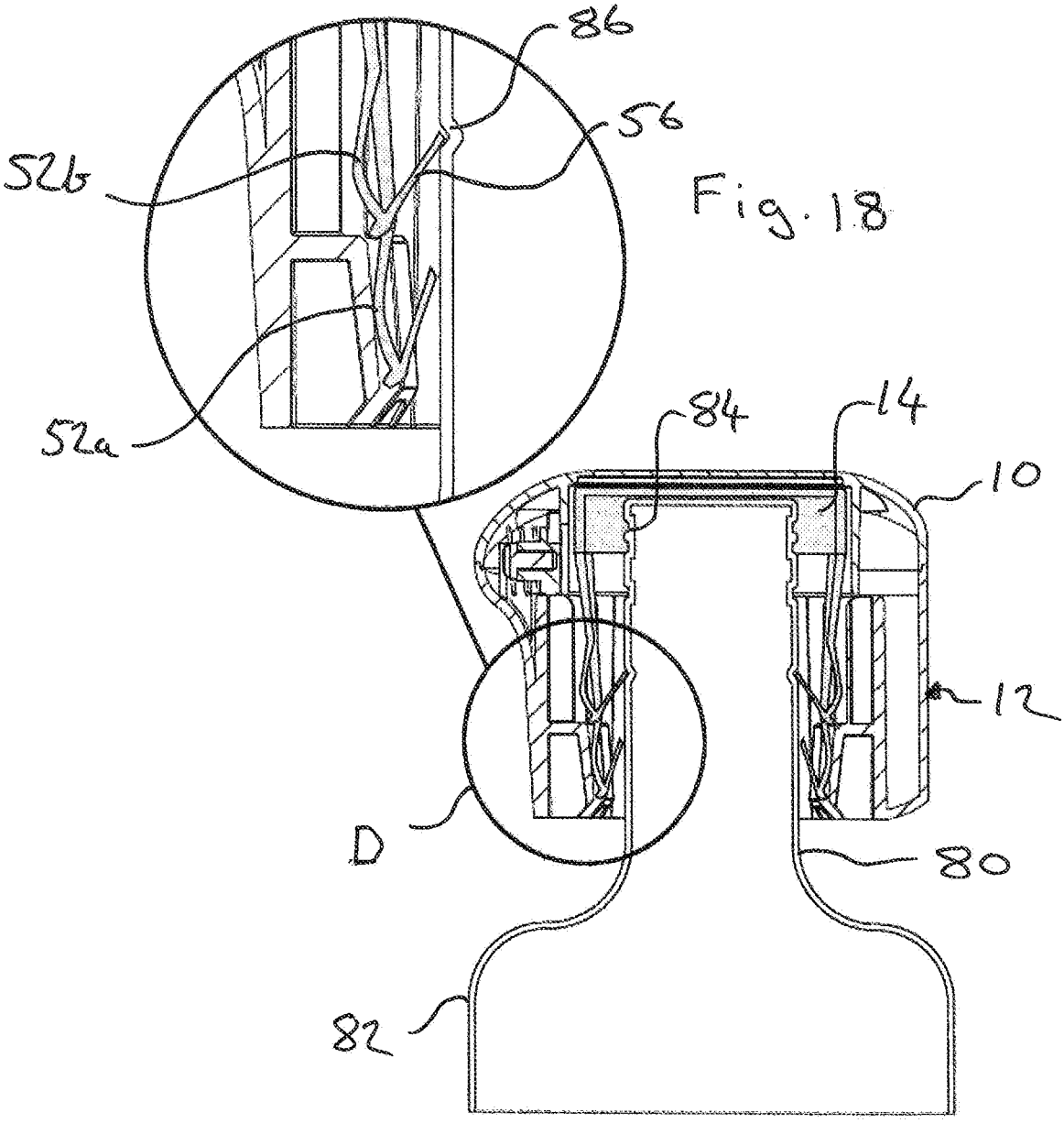
FIG. 17 is a cross sectional view of the device of FIG. 1 mounted to the neck of a bottle.
FIG. 18 is an enlarged view of detail Din FIG. 17.
Figure 19:
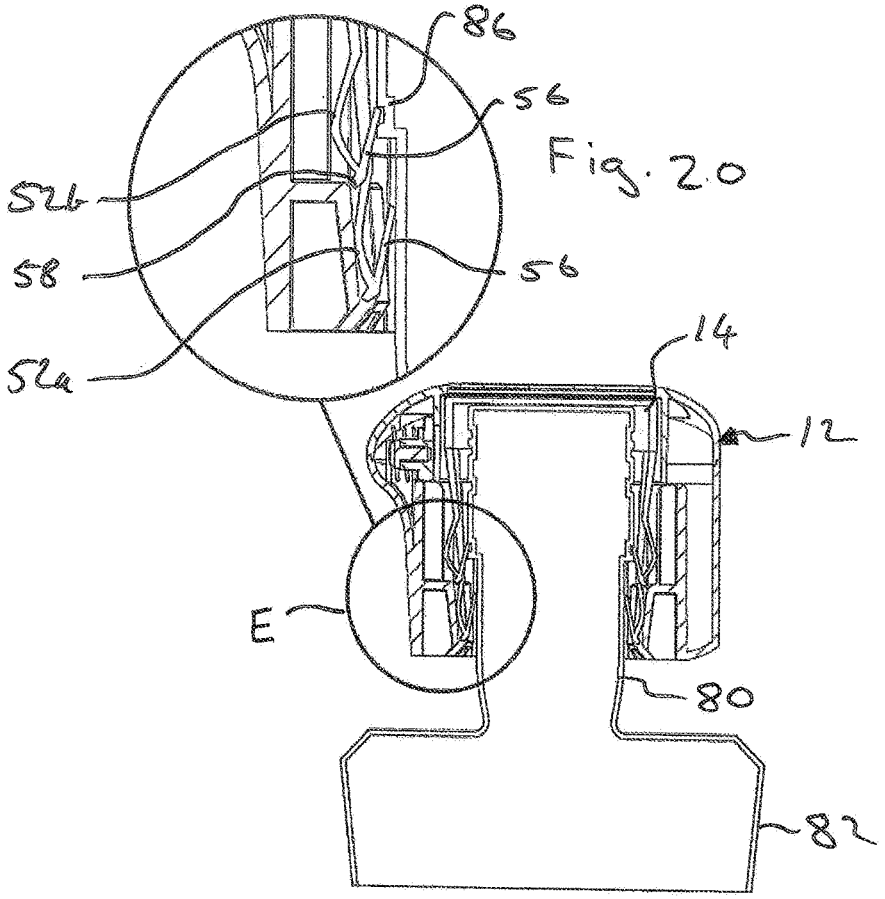
FIG. 19 is a view similar to that of FIG. 17 but illustrating how the device can be fitted to a differently shaped bottle neck.

Movement of the claw member 14 to the operative position draws the end regions of the claws 52 and the bottle neck engaging feet 56 inside the outer cap structure 12. It will be noted that the upper surfaces of the claw legs 54 are biased into engagement with the lower, free edge of the annular housing portion 16. As the claw member 14 is moved from the inoperative position towards the operative position, the claw abutments 58 are brought into engagement with the outer surface of the annular housing portion. Further movement of the claw member 14 towards the operative position results in the bottle engaging feet 56 being inverted as they are drawn inside the annular housing portion so as to extend radially inwardly and upwardly towards the end cap portion due to engagement of the claw abutments 58 with the annular housing portion. The feet 56 are held in this orientation through contact of the claw abutments 58 with the inner surface of the annular housing portion 16 once the claws are drawn fully inside the annular housing portion. In this configuration, which is shown in FIG. 16, the feet 56 are operative to engage with the neck of a bottle to which the device 10 is mounted, with the toe portions 56*a* angled upwardly towards the free end of the bottle neck to engage with a lip of the bottle from below. When the claw member 14 is in its operational position, the lower edges of the claw abutments 58 on the longer set of claws 52*a* are substantially aligned parallel to the lower edge of the annular housing portion 16.

Figure 9:
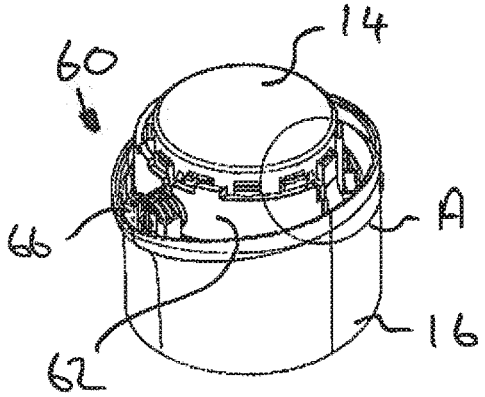
FIG. 9 is a perspective view of part of the device of FIG. 1 with an end cap portion removed to show details of a magnetically releasable latch arrangement in a latching configuration.
Figure 10:
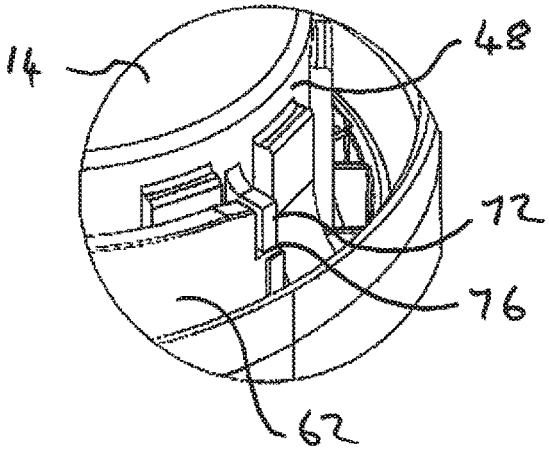
FIG. 10 is an enlarged view of detail A in FIG. 13.
Figure 11:
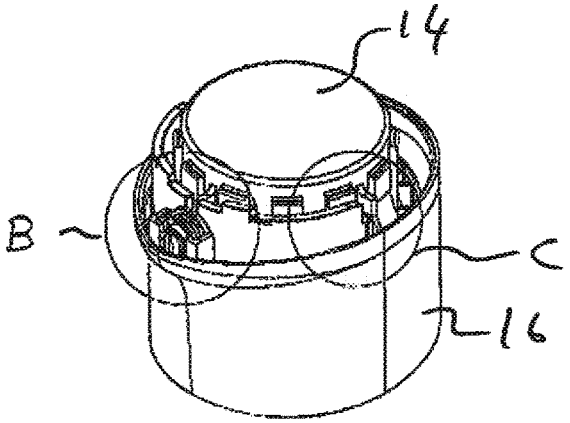
FIG. 11 is a perspective view similar to that of FIG. 9 but showing the latch arrangement in a release configuration.
Figure 12:
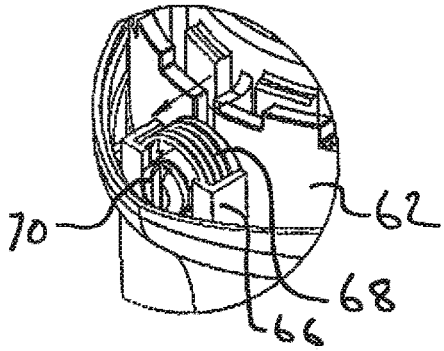
FIG. 12 is an enlarged view of detail B in FIG. 11.
Figure 13:
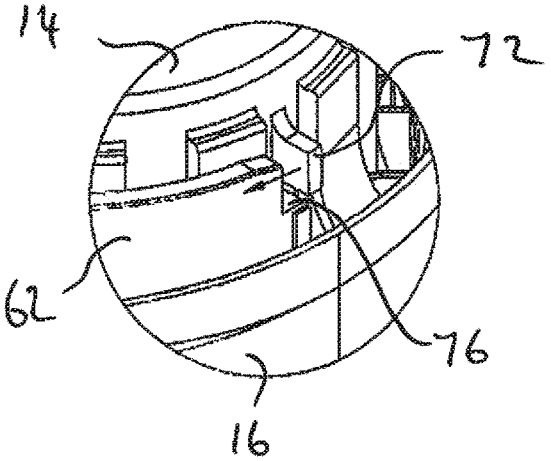
FIG. 13 is an enlarged view of detail C in FIG. 11.

The device 10 has a magnetically releasable latching arrangement (indicated generally at 60) for releasably holding the claw member 14 in the operative position within the outer cap structure 12. The latching arrangement includes a curved, arcuate latch element 62 which is mounted at the top of the annular housing portion 16 and within the end cap portion 18. The latch element 62 is dimensioned to extend about and partially encircle the flange 40 of the end cap portion 18. The latch element has a central boss 64 which locates at the front of the outer cap structure and is slidingly engaged in a channel-like support formation 66 at the upper end of the annular housing portion. The latch element 62 is able to move laterally relative to the longitudinal axis of the annular housing portion 16 (that is to say in a direction from front to rear of the outer cap structure) between a radially inward latching position as shown in FIGS. 9 and 10 and a radially outward release position as shown in FIGS. 11 to 13. A coil spring 68 is located about the boss 64 and is operative in compression between the latch element 62 and the support formation 66 to bias the latch element 62 towards the latching position. The latch element 62 is magnetically influenced, that is to say it can be moved from the latching position to the release position against the bias of the spring 68 by the application of a suitable magnetic field externally of the outer cap structure 12. In this embodiment, a ferromagnetic screw 70 is mounted to the boss 64 such that application of a magnetic attraction force externally of the outer cap structure at the front acts on the screw 70 drawing the latch element 62, forwardly to the release position compressing the coil spring 68. The arrangement is configured so that release of the latch arrangement requires use of a specific magnetic field such that the device cannot be unlatched using a common magnet The required magnetic field will typically be applied by a suitable magnetic key as is known in the art.

Figure 14:
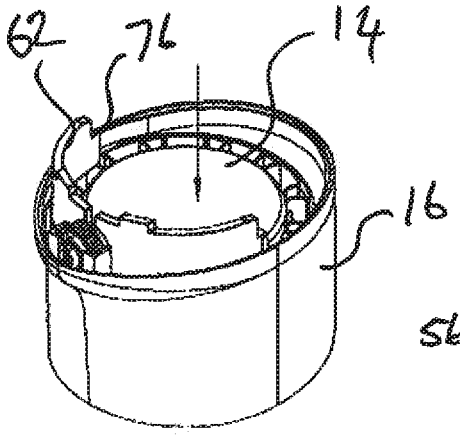
FIGS. 14 and 15 are a series of a perspective views similar to that of FIG. 11 illustrating movement of a claw member from an operative position to an inoperative position whilst the latch arrangement is in the release configuration.
Figure 15:
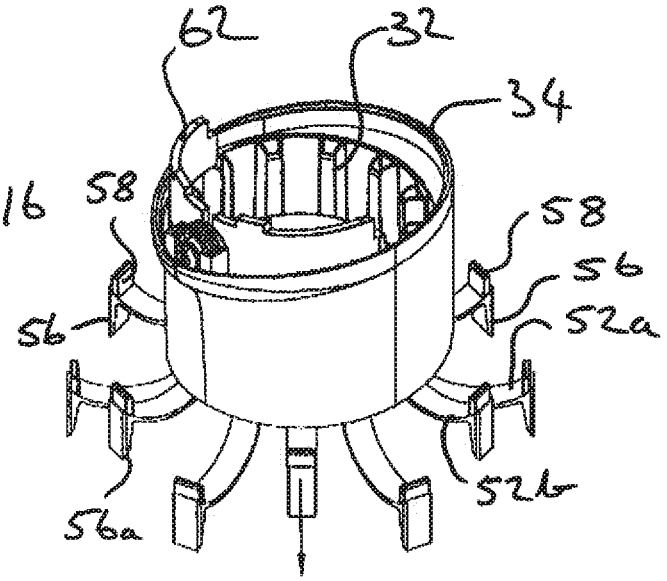

A pair of latch formations 72 project radially outwardly from the side wall 48 of the claw member body portion 44 on opposite sides. When the claw member 14 is in the operative position, the latch formations extend through corresponding slots 74 in the annular flange 40 in the end cap portion 18 into the space between the flange 40 and the exterior wall 38 of the end cap portion occupied by the latch element 62. Opposite end regions of the latch member 62 are profiled to define upwardly directed abutment surfaces 76 which engage the latch formations 72 when the claw member 14 is in the operative position and the latch element 62 is in the latching position to prevent the claw member moving from the operative position to the release position. This is illustrated in FIGS. 9 and 10. On movement of the latch element 62 to the release position, the ends of the latch element 62 are drawn forwardly, disengaging the abutment surfaces 76 from the latch formations 72, as shown in FIGS. 11 to 13. This enables the claw member 14 to be moved to the inoperative position as illustrated in FIGS. 14 and 15.

The device 10 is assembled by locating the claw member 14 in the annular housing portion 16 through the upper end prior to mounting of the end cap portion 18. When assembling the claw member 14 in the annular housing portion, the claws 52 can be squeezed together so that the claw abutments 58 engage the inner surface of the annular housing member to hold the feet 56 inverted. In this case, the claw member 14 is placed directly in the operational position. Alternatively, the claw member 14 can be inserted until the free ends of the claws 52 project out of the annular housing member at the bottom and then moved to its operational position so that the bottle neck engaging feet 56 are drawn back inside the annular housing portion and inverted. Once the claw member is in its operational position, the latch element 62 with the screw 70 mounted to it and the latch spring 68 are assembled to the annular housing portion to hold the claw member in the operational position. The end cap portion 18 is then fitted to the annular housing portion 18 enclosing the latching arrangement and the end cap portion 18 and annular housing portion 16 are secured together, typically be welding. Once assembled with the claw member in the operational position as shown in FIG. 16, the device 10 is ready to use.

In use, the device 10 is mounted to the neck 80 of a bottle 82 as illustrated in FIGS. 17 to 20. Bottles 82 for which the device is intended for use will typically have a closure in the form of a screw cap 84 as shown or a cork type closure. Such bottles have a lip on the outer surface of the neck which presents a downwardly facing, lower surface 86. The device 10 is fitted by inserting the neck into the aperture 50 in the claw member between the claw feet 56. The device is dimensioned so that the bottle neck engaging feet 56 are pressed into contact with the outer surface of the bottle neck. The resilient nature of the claws 52 enables bottle necks having a wide range of diameters and shapes to be accommodated. The device is pressed onto the bottle neck until the feet of at least one set of claws are located below the lip 86 on the bottle neck. The device is dimensioned so that for the majority of bottle necks the feet 56 of both sets of claws locate below the lip 86. In this case, the feet of the shorter set of claws 52 engage with the lip 86 from below and prevent the device from being removed and the longer set of claws 52*a* act as back up in case the first set fail. However, for bottles having a longer than usual neck, it may be that only the feet of the longer set of claws 52*a* are able to locate below the lip 86 on the bottle neck. In use, the feet 56 may not engage the lip 86 when the device is fitted but may locate below the lip so that the device has a limited amount of free play before the toe regions 56*a* of the feet engage the lip. This is advantageous as the device 10 can be applied without using excessive force thus reducing the likelihood of damaging any labelling or security seal on the bottle.

Once the device 10 is locked to a bottle neck it cannot be easily removed as the feet engage below the lip 86 on the bottle to hold the device firmly in position. To release the device 10, an appropriate magnetic key is used to move the latch element 62 to the release position and the outer cap structure 12 is drawn upwardly away from the bottle. However, the claw member 14 is unable to move with the outer cap structure due to engagement of the claw feet 56 of at least one set of claws with the lip of the bottle. As a result, the outer cap structure 12 is drawn upwardly relative the claw member 14 until the free ends of the claws exit the annular housing portion. At this point, the claws 52 return to their natural resiliently biased configuration in which the feet 56 extend downwardly outside the annular housing portion and are unable to engage the lip of the bottle. The device 10 can now be fully removed from the bottle neck.

After removal of the device 10, it can be re-set for further use by moving the latch element 62 to the release position using an appropriate magnetic field, moving the claw member 14 back to the operative position with the feet 56 inside the annular housing portion, and removing the magnetic field so that the latch member moves back to the latching position to hold the claw member in the operative position. In an alternative embodiment, the claw member 14 and the latch element 62 are provided with co-operating formations which engage when the claw member 14 is moved from the inoperative position to the operative position and are profiled to physically move the latch member 62 to the release position. This allows the device 10 to be re-set after use without the need to use a magnetic key. In one embodiment, the latch formations 72 and the corresponding ends of the latch element 62 are profiled so that engagement of the latch formations 72 with the latch element as the claw member 14 is moved from the inoperative position towards the operative position causes the latch element 62 to be moved to the release position.

When the device 10 is locked to the neck of a bottle it prevents access to the bottle closure 84 so that the contents of the bottle cannot be dispensed. Accordingly, the device can be used as a safety device to prevent accidental or unauthorized access to the contents of a bottle. The device 10 can also be provided with an element for triggering an alarm in a retail environment or the like. The alarm element may be an RF or RFID tag for example. This allows the device 10 to be used as an anti-theft device.

A device 10 in accordance with the invention can be fitted easily to a broad range of bottles with differing neck sizes and shapes due to the provision of claws of different sizes and the inherent flexibility of the claws. A particular advantage of the device 10 is that it can be fitted to a bottle quickly and easily using appropriate machinery so that the process of fitting devices 10 to bottles can be automated. This would allow for fitting of devices 10 to bottles at a central location, say by a distiller or distributor, with the bottles being delivered to retailers with the devices already applied. This eliminates the need for retailers to apply the devices 10 in store, reducing labour and costs. Following removal of the devices 10, they can be returned to be re-set and reused.

The above embodiments are described by way of example only. Many variations are possible without departing from the scope of the invention as defined in the appended claims. For example, the device 10 could have more than two sets of claws of differing sizes.

The invention claimed is:

1. A security device for mounting over the neck of a closed bottle having an exterior lip, the device having an outer cap structure including an annular housing portion for location about the neck of a bottle and an end cap portion at one end of the annular housing portion, a claw member slidably mounted to the outer cap structure for movement in a direction parallel to a longitudinal axis of the annular housing portion between operative and inoperative positions, and a latch mechanism for releasably securing the claw member in the operative position, the claw member having a plurality of resiliently deformable elongate claws for engagement with the neck of a bottle to which the device is mounted when the claw member is in the operative position, and wherein the plurality of resiliently deformable elongate claws are provided as at least two sets of claws of different lengths.

2. A security device as claimed in claim 1, wherein the at least two sets of claws include a first set of claws and a second set of claws, the claws in the first set of claws being longer than the claws in the second set of claws.

3. A security device as claimed in claim 1, wherein the claw member comprises a body portion slidably mounted in the outer cap structure, the plurality of resiliently deformable elongate claws being spaced apart about the body portion.

4. A security device as claimed in claim 3, wherein the claws in the first set of claws being longer than the claws in the second set of claws and the claws of the first set of claws and the second set of claws are alternately disposed about the body portion.

5. A security device as claimed in claim 1, wherein the claws of the at least two sets of claws are wholly received within the outer cap structure when the claw member is in the operative position, and wherein free end portions of the claws of the at least two sets of claws project externally from the outer cap structure when the claw member is in the inoperative position.

6. A security device as claimed in claim 1, wherein each resiliently deformable elongate claw comprises an elongate resiliently deformable leg having a bottle neck engaging formation at one end.

7. A security device as claimed in claim 6, wherein the bottle neck engaging formations are located externally of the outer cap structure when the claw member is in the inoperative position and are located within the outer cap structure when the claw member is in the operative position.

8. A security device as claimed in claim 7, wherein the bottle neck engaging formations comprise feet which extend from the free end of their respective claw legs in a first direction, the arrangement configured such that when the claw member is in the operative position, the claw feet are directed radially inwardly and towards the end cap portion for engagement with the neck of a bottle.

9. A security device as claimed in claim 8, wherein each resiliently deformable elongate claw comprises an abutment extending from the free end of the leg in the opposite direction to the foot for engagement with the annular housing portion, the arrangement configured such that when the claw member is in the operative position, engagement of the abutment with the annular housing portion holds the foot so that it extends radially inwardly and towards the end cap.

10. A security device as claimed in claim 9, wherein the device is configured such that when the claw member is in the inoperative position and the bottle engaging formations are located outside of the annular housing portion, each foot is biased by the resilience in its respective leg to project in a direction away from the end cap.

11. A security device as claimed in claim 1, wherein the annular housing portion defines a central aperture which is open at a first end to receive the neck of a bottle, the central aperture being substantially closed at the opposite end by the end cap portion.

12. A security device as claimed in claim 10, wherein the end cap portion and the annular housing portion are initially separate components assembled together.

13. A security device as claimed in claim 1, wherein the latch mechanism comprises a magnetically-releasable latch element for securing the claw member in the inoperative position.

14. A security device as claimed in claim 13, wherein the claw member has one or more latch formations and the latch element is mounted in the outer cap structure for movement between a latching position and a release position, the arrangement being configured such that when the claw member is in the operative position and the latch element is in the latching position, the latch element engages the one or more latch formations to inhibit movement of the claw member to the inoperative position, and when the latch element is in the release position it does not engage the one or more latch formations and the claw member is able to move between the operative and inoperative positions.

15. A security device as claimed in claim 14, wherein the latch element is resiliently biased to the latching position, the latch element being movable to the release position against the bias when subjected to a selected magnetic field externally of the outer cap.

16. A security device as claimed in claim 15, wherein the latch element comprises a ferromagnetic member.

17. A security device as claimed in claim 14, wherein the claw member comprises a body portion slidably mounted in the outer cap structure, the claws being spaced apart about the body portion, the latch element being arcuate and mounted within the outer cap structure such that the body portion of the claw member passes within the latch element for movement between operative and inoperative positions, the body portion having at least two said latch formations projecting outwardly and spaced apart for engagement with latch element when the latch element is in the latching position and the claw member is in the operative position.

18. A method of using a security device as claimed in claim 1, the method comprising applying the security device to a bottle using machinery.

19. A method of using a security device as claimed in claim 18, the method comprising applying the device to a bottle at a first location and transporting the bottle with the device applied to a second location.

20. The method of using a security device of claim 19, wherein said first location is a distillery or distribution centre, and said second location is a retail outlet.

* * * * *